United States Patent [19]

Schoch et al.

[11] Patent Number: 4,744,284

[45] Date of Patent: May 17, 1988

[54] DEVICE FOR LIMITING THE FIELD OF FIRE IN ELEVATION ON AN AUTOMATIC FIREARM

[75] Inventors: Carlos Schoch, Steinmaur; Arto Airio, Nussbaumen, both of Switzerland

[73] Assignee: Werkzeugmaschinenfabrik Oerlikon-Bührle AG, Zürich, Switzerland

[21] Appl. No.: 16,013

[22] Filed: Feb. 18, 1987

[30] Foreign Application Priority Data

Mar. 4, 1986 [CH] Switzerland ..... 00879/86

[51] Int. Cl.[4] ..... F41D 11/02

[52] U.S. Cl. ..... 89/134

[58] Field of Search ..... 89/41.18, 134

[56] References Cited

U.S. PATENT DOCUMENTS

| | | | |
|---|---|---|---|
| 1,651,699 | 12/1927 | Halsey | 89/134 |
| 2,196,269 | 4/1940 | Morris | 89/134 |
| 2,483,385 | 9/1949 | Humphrey | 89/41.18 |
| 2,582,225 | 1/1952 | Bowser et al. | 89/134 |
| 3,821,920 | 7/1974 | Brieger | 89/190 |

FOREIGN PATENT DOCUMENTS 2194938 3/1974 France .

OTHER PUBLICATIONS

Webster's New World Dictionary of the American Language, College Edition, 1957, p. 184.

*Primary Examiner*—Stephen C. Bentley
*Attorney, Agent, or Firm*—Werner W. Kleeman

[57] ABSTRACT

A device for limiting the field of fire in elevation on an automatic firearm prevents the weapon from being fired when it is in certain, unsuitable positions. The weapon may not then be operated by either the electrical or the mechanical trigger. The operation of an electrical switch when the weapon is swung beyond a given angle of elevation to disconnect the electrical trigger is known. According to the invention, when the weapon is swung beyond the given angle of elevation known firing pin locks are mechanically actuated, which prevents the advancing breechblock which pushes the cartridge into the gun barrel from piercing the cartridge. A cam roller or follower is preferably arranged on the weapon and which strikes a fixed lifting flank or cam when the weapon is swung at a given angle of elevation.

3 Claims, 1 Drawing Sheet

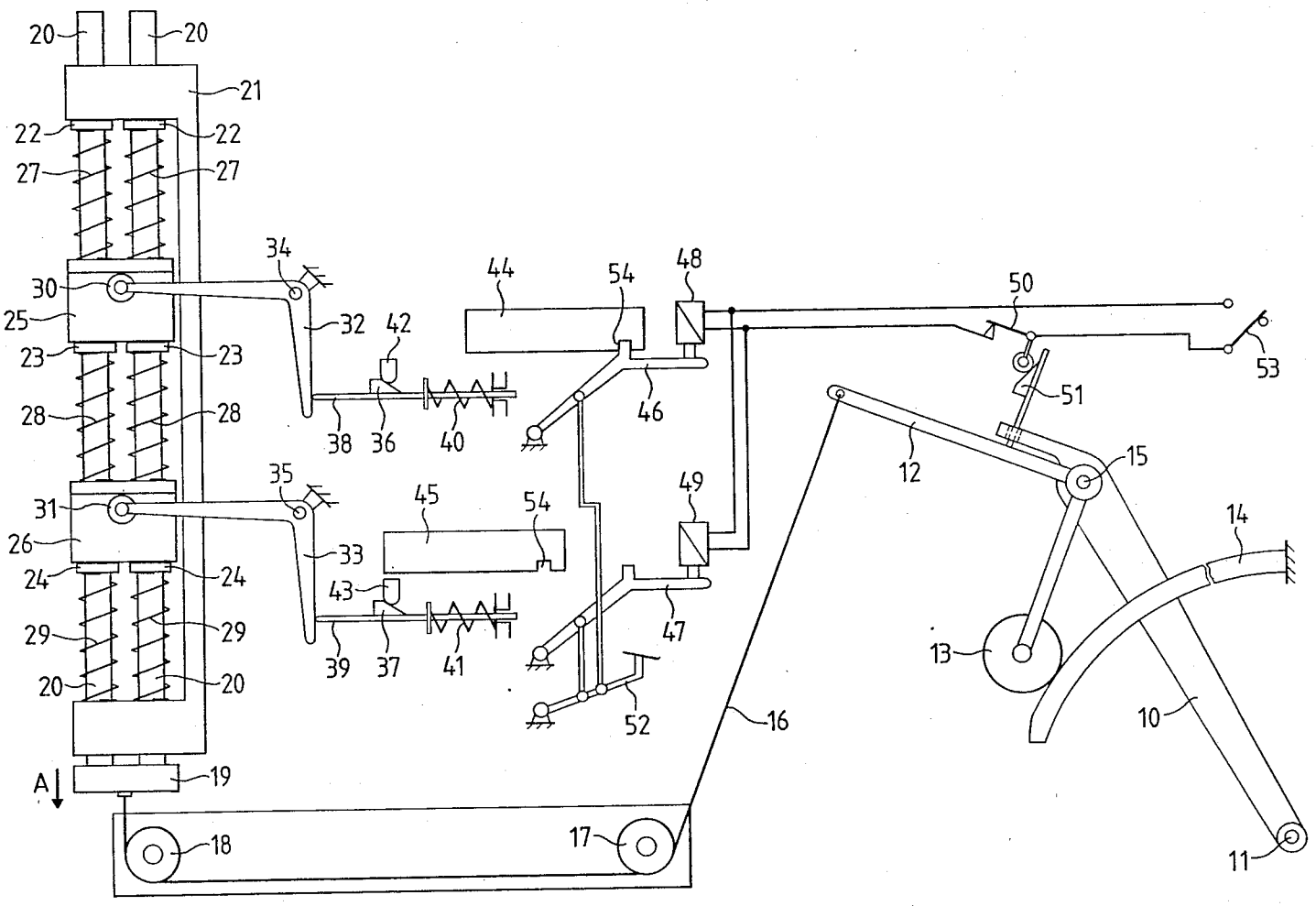
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
A

DEVICE FOR LIMITING THE FIELD OF FIRE IN ELEVATION ON AN AUTOMATIC FIREARM

BACKGROUND TO THE INVENTION

The present invention relates to a device for limiting the field of fire in elevation on an automatic firearm having an electrical trigger and a switch for disconnecting the electrical trigger as soon as the firearm exceeds a given angle of elevation.

In a known device of this type (see U.S. Pat. No. 2,483,385) the electrical trigger is disconnected if the firearm exceeds either a given azimuth angle or a given angle of elevation.

In another known device of this type (See U.S. Pat. No. 2,582,225), on the one hand an electrically, and, on the other, a manually operated trigger is disconnected if the firearm exceeds either a given azimuth angle or a given angle of elevation.

These known devices are primarily useful when the respective allowable angle of elevation depends on the azimuth angle, and vice versa. This is the case if a firearm is near to houses which must not be fired on, or if the field of fire on an aircraft-mounted gun must be restricted so that parts of the aircraft on which the weapon is mounted cannot be hit.

If it is only necessary to limit the field of fire in elevation, independent of the azimuth angle, the device can be made substantially simpler in design. In particular the device may be simplified greatly if firing is not to be possible at maximum elevation. This device is intended to be especially suited to weapons that can be fired independently of each other both via a manual and via an electrical trigger. Such a weapon exhibits, for example, a reciprocating breechblock held in its rearmost position by a pawl against the force of a recuperator spring. This breechblock has a firing pin which pierces the cartridge when the breechblock travels forward. This weapon is also provided with a firing pin or lock means. This firing pin lock possesses an arresting or catch element which in its arresting or catch position projects into the path of the breechblock and is driven home i.e. placed in its catch position by a locking element, to arrest the breechblock just before its firing position. In addition there is disposed a second arresting or catch element which is driven home by said locking element and which when driven home is moved into the path of the breechblock against the force of a first spring. This firing pin lock is described at length in Swiss Pat. No. 556,524 and the cognate U.S. Pat. No. 3,821,920 and will therefore not be discussed in more detail here.

The problem to be solved by the present invention consists in creating a device for limiting the field of fire which prevents the weapon being fired not only by the electrical trigger but also by the mechanical trigger. This problem is solved in accordance with the invention by the fact that a lock means or firing pin lock can be actuated when the given angle of elevation is exceeded.

BRIEF DESCRIPTION OF THE DRAWING

One embodiment of the device for defining or limiting the field of fire, that is the angle of elevation, in which the weapon cannot be fired, is outlined below in detail with the aid of the appended drawing. The drawing shows all the parts of the device of the invention in a schematic representation.

DETAILED DESCRIPTION OF THE PREFERRED EMBODIMENT

According to this single figure, a lever 10 swivelling about the trunnion axis 11 on the barrel of a firearm, not illustrated, is so attached as to be traversed about the same angle of elevation as the barrel when the weapon is swivelled. On this lever 10 there is pivotably hinged a bell-crank lever 12, on which a cam roller or follower 13 is rotatably mounted. This cam roller 13 can travel up a lifting flank or cam 14 when the weapon is swivelled about the elevation axis, causing the bell-crank lever 12 to be swung about its axis 15. The lifting flank or cam 14 is attached permanently but adjustably to a part of the weapon that cannot be traversed about the elevation axis, such that at a selectable angle of elevation the cam roller or follower 13 travels up the lifting flank 14 and in so doing swings or pivots the bell-crank lever 12. A cable 16 is attached to the bell-crank lever 12 and passes over two fixed guide rollers 17 and 18. This cable 16 is attached to a slide 19, to which are attached two rods 20 displaceably mounted in a fixed bracket 21. Three stops 22, 23 and 24 are attached to each of these two rods 20. In addition two cradles or carriages 25 and 26 are displaceably mounted on the two rods 20. Between the uppermost stops 22 and the cradle 25 there are located two springs 27 and between the middle or intermediate stops 23 and the other cradle 26 there are located two further springs 28. Finally another two springs 29 are located between the lowermost stops 24 and the bracket 21. These lowermost springs 29 try to push the rods 20 upwards against the direction of the arrow A. The springs 29 are compressed when the cable 16 is pulled. The springs 27 try to press the cradle 25 against the stops 23 and the springs 28 try to press the cradle 26 against the stops 24.

On each of the two cradles 25 and 26 there is supported a cam roller or follower 30 and 31, which are rotatably hinged respectively on a bell-crank lever 32 and 33. The two bell-crank levers 32 and 33 respectively swivel about a reversible axis 34 and 35.

It should also be noted that the weapon moves backwards at each shot. The bracket 21 with rods 20 does not, however, move backwards. But the bell-crank levers 32, 33 pivotably hinged on the weapon also move back, while the cam rollers or followers 30 and 31 move back and forth on the cradles or carriages 25 and 26.

The two bell-crank levers 32 and 33 serve to actuate two rods 38 and 39 provided with lifting flanks 36 and 37. These rods 38 and 39 are displaceably mounted and are pressed by springs 40 and 41 against the bell-crank levers 32 and 33. The lifting flanks 36 and 37 serve to displace firing pin locks or lock means 42 and 43. The vertically displaceable firing pin locks or lock means 42 and 43 each prevent the advance of a breechblock 44 and 45, respectively. The two breechblocks 44 and 45 are kept in their rearmost position by pawls 46 and 47, respectively. Electromagnets 48 and 49 are provided to respectively operate the two pawls 46 and 47. These two electromagnets 48 and 49 are actuable by a common switch 50. A control shaft 51 is displaceably affixed to the lever 10, which has already been mentioned, said control shaft 51 allowing the switch 50 to be actuated when the lever 10 is swivelled or pivoted. This control shaft 51 is supported on the bell-crank lever 12. When the roller 13 runs up the lifting flank 14 the control shaft 51 is shifted via the bell-crank lever 12 and the switch 50 opens. A mechanical trigger 52 serves to release the breechblocks 44, 45, i.e. to start firing. In addition firing can be started using an electrical trigger, e.g. a switch 53.

The mode of operation of the foregoing apparatus is as follows:

For the foregoing firearm to be ready to fire the breechblock 45 must be cocked, i.e. it must be shifted from its frontmost position, against the force of a recuperator spring (not shown), to the right until the pawl 47 can engage in a recess 54 in the breechblock 45. The breechblock 44 has already been cocked and pawl 46 is engaged in the recess 54 of breechblock 44. Firing can now be commenced as follows, by selecting either the trigger 52 or the switch 53.

1. If firing is initiated by closing the switch 53, the two electromagnets 48 and 39 are excited or energized and knock pawls 46 and 47 out of the recesses 54 of the two breechblocks 44 and 45. The breechblocks 44, 45 move forwards under the force of the recuperator spring and each triggers a single shot or burst of fire, depending on whether the firearm is programmed for single shots or repeated fire. However, if the weapon is swung past a permitted angle of elevation the roller or cam follower 13 hits the lifting flank or cam 14, causing the bell-crank lever 12 to swivel, the control shaft 51 is shifted and opens the switch 50. The two electromagnets 48, 49 are then no longer exicted or energized and neither a single shot nor a burst of fire is possible If during a burst of fire the weapon is swung past the permitted angle of elevation, the burst of fire is interrupted.

2. If firing is initiated by operating the mechanical trigger 52, the two pawls 46 and 47 are in each case swung out of the recess 54 of the two breechblocks 44 and 45. The breechblocks 44, 45 move forward under the force of the associated recuperator spring and trigger a single shot or a burst of fire, depending on whether the firearm is programmed for single shots or repeated firing. However, if the weapon is swung past a permitted angle of elevation, the roller or follower 13 hits the lifting flank or cam 14, causing the bell-crank lever 12 to swivel and the slide 19 is shifted with the rods 20 via the cable 16 against the force of the springs 29. The stops 23 and 24 on the rods thus likewise shift (downwards in the drawing) and the springs 27 and 28 are able to displace the cradles or carriages 25 and 26. Thus the bell-crank levers 32 and 33 are also swivelled in anti-clockwise direction and displace the rods 38,39 to the right, against the force of springs 40,41. At the same time the two firing pin locks or lock means 42 and 43 are pushed via the lifting flanks 36 and 37 into the path of the breechblocks 44, 45. The breechblocks 44 and 45 are therefore no longer able to pierce a cartridge. A burst of fire is interrupted and a single shot prevented.

While there are shown and described present preferred embodiments of the invention, it is to be distinctly understood that the invention is not limited thereto, but may be otherwise variously embodied and practiced within the scope of the following claims. Accordingly,

We claim:

1. An automatic firearm field of fire limiting device for a firearm having an electrical trigger, a mechanical trigger and a movable breechblock movable to perform an advance movement and a movement into a rearmost position, comprising:

switch means for disconnecting said electrical trigger when the switch means is actuated;

firing pin lock means for preventing advance movement of said breechblock and rendering ineffectual said mechanical trigger;

elevation angle detection means detecting when the firearm has exceeded a predetermined angle of elevation and operative to activate said switch means and said firing pin lock means to disconnect the electrical trigger and inactivate said mechanical trigger;

cam means for operating the switch means and the firing pin lock means;

a lifting flank adapted to be fixedly located at a firing position for the firearm, so that said cam means contacts said lifting flank and is raised by said lifting flank when the firearm is elevated;

linkage means linking said cam means to said firing pin lock means to activate said firing pin lock means when the firearm exceeds a predeterminate angle of elevation;

said linkage means comprising:

fixedly mounted bracket means;

spring-loaded control means mounted in said fixedly mounted bracket means;

cable means connecting said cam means and said spring-loaded control means such that movement of said cam means on said lifting flank during elevation of the firearm displaces said spring-loaded control means against the spring-loading of said spring-loaded control means;

follower means mounted for recoil with the firearm and contacting said spring-loaded control means and maintaining contact with said spring-loaded control means during recoil of the firearm; and said follower means displacing said firing pin lock means upon displacement of said spring-loaded control means.

2. The automatic firearm field of fire limiting device as defined in claim 1, wherein:

said follower means comprising bell crank means;

spring-loaded rod means urged against said bell crank means for displacement of said spring-loaded rod means by said bell crank means upon displacement of said spring-loaded control means; and lifting flank means mounted on said spring-loaded rod means for lifting said firing pin lock means upon displacement of said spring-loaded rod means in order to activate said firing pin lock means.

3. The automatic firearm field of fire limiting device as defined in claim 1, further including:

electromagnet means operated by said switch means;

pawl means for engaging said breechblock of the firearm in order to hold said breechblock in the rearmost position thereof;

said pawl means being activatable by said electromagnet means in order to release said breechblock from retention in said rearmost position; and said switch means being operable by said cam means to de-energize said electromagnet means when said firearm exceeds the predetermined angle of elevation.

* * * * *